US006474316B1

(12) United States Patent
Yamaguchi

(10) Patent No.: US 6,474,316 B1
(45) Date of Patent: Nov. 5, 2002

(54) FUEL REFORMING DEVICE

(75) Inventor: Teruyasu Yamaguchi, Niigata (JP)

(73) Assignee: Hinomaru Shokai Co., Ltd. (JP)

( * ) Notice: Subject to any disclaimer, the term of this patent is extended or adjusted under 35 U.S.C. 154(b) by 0 days.

(21) Appl. No.: 09/980,003

(22) PCT Filed: May 30, 2001

(86) PCT No.: PCT/JP01/02754

§ 371 (c)(1),
(2), (4) Date: Nov. 27, 2001

(87) PCT Pub. No.: WO01/75293

PCT Pub. Date: Oct. 11, 2001

(51) Int. Cl.[7] ..... F02M 27/04
(52) U.S. Cl. ..... 123/538
(58) Field of Search ..... 123/538, 536, 123/537

(56) References Cited

U.S. PATENT DOCUMENTS 5,637,226 A * 6/1997 Adam et al. ..... 210/695
5,863,404 A * 1/1999 Fujimaki ..... 123/538
6,405,719 B2 * 6/2002 Nozato ..... 123/538

* cited by examiner

*Primary Examiner*—Marguerite McMahon
(74) *Attorney, Agent, or Firm*—Schnader Harrison Segal & Lewis LLP

(57) ABSTRACT

A fuel reforming device comprising a fuel lead-in pipe, a forward travel fuel pipe wound spirally toward a first direction with a spiral diameter gradually decreasing, a flow direction reversing pipe for reversing the direction of fuel flow from the forward travel fuel pipe in a second direction opposite to the first direction, a backward travel fuel pipe wound spirally toward the second direction with a spiral diameter gradually increasing in a winding direction opposite to that of the forward travel fuel pipe, and a fuel lead-out pipe, wherein a filler containing a silicon compound is placed around the forward travel fuel pipe, the flow direction reversing pipe and the backward travel fuel pipe. The fuel reforming device makes it possible to greatly reduce exhaust smoke and nitrogen oxides, to reduce other components such as carbon dioxide, and to improve the output and the rate of consumption of fuel for engines using reformed fuel.

12 Claims, 10 Drawing Sheets

FUEL REFORMING DEVICE

TECHNICAL FIELD OF THE INVENTION

The present invention relates to a fuel reforming device, and specifically, relates to a fuel reforming device suitable to reform fuel for internal combustion engines such as gasoline engines or diesel engines and the like used for motorcars or ships, and fuel for external combustion engines such as burners for boilers and the like.

BACKGROUND ART OF THE INVENTION

In internal combustion engines or external combustion engines, for example, in internal combustion engines for motorcars and the like, it is desirable to reduce carbon dioxide, nitrogen oxides, or an exhaust smoke (called also as a black smoke or particles) and the like, and to improve the fuel consumption rate (called also as simply "fuel consumption"). To satisfy these requirements, it is efficient to reform a fuel to be used, as well as to improve the combustion efficiencies of internal combustion engines or external combustion engines themselves.

As a device for reforming a fuel, a fuel reforming device is known wherein a carbon rod and a coil surrounding the periphery of the rod are disposed inside a fuel pipe wound spirally, both ends of the coil are connected to both ends of the fuel pipe, powder of a metal, a mineral and an oxide compound are filled between the fuel pipe and an inner wall of a housing, and they are solidified by a silicone resin (JP-A-HEI 10-77483).

According to this JP-A-HEI 10-77483, when the device was examinated using a motorcar, it is described that the fuel combustion volume was improved by 46%, and the exhaust volume was decreased to about 40% in NOx, to about 58% in HC, and to about 50% in CO in the exhaust gas, but the kinds of the motorcar and the conditions of the examination are not specified, and there is no description about an exhaust smoke.

In general, there is a trade-off relationship especially between the exhaust volume of nitrogen oxides (NOx) and the volume of exhaust smoke, a combustion method or a fuel reforming method for reducing both of them has not been found. Therefore, in the device proposed by the above-described JP-A-HEI 10-77483, it is considered particularly that the concentration of the exhaust smoke had increased.

DISCLOSURE OF THE INVENTION

Accordingly, it is an object of the present invention to provide a fuel reforming device which can greatly reduce both of an exhaust smoke and nitrogen oxides having a trade-off relationship with each other, which can reduce other components such as carbon dioxide and the like, and which also can improve a fuel consumption rate.

To accomplish the above object, a fuel reforming device according to the present invention comprises a fuel lead-in pipe, a forward travel fuel-pipe communicated with the fuel lead-in pipe and wound spirally toward a first direction with a spiral diameter gradually decreasing, a flow direction reversing pipe for reversing the direction of fuel flow from the forward travel fuel pipe in a second direction opposite to the first direction, a backward travel fuel pipe communicated with the flow direction reversing pipe and wound spirally toward the second direction with a spiral diameter gradually increasing in a winding direction opposite to that of the forward travel fuel pipe, and a fuel lead-out pipe communicated with the backward travel fuel pipe, wherein a filler containing a silicon compound is placed around the forward travel fuel pipe, the flow direction reversing pipe and the backward travel fuel pipe.

The above-described filler comprises silicate compounds such as silicate dioxide and the like, or a mixture of it and other substances, and it is preferably formed as a formation of powder in order to be easily filled.

It is preferred that at least the forward travel fuel pipe and the backward travel fuel pipe are made from copper or a copper-system material (for example, brass).

Further, the forward travel fuel pipe and the backward travel fuel pipe are wound spirally at a substantially same position. For example, the backward travel fuel pipe is spirally wound inside the forward travel fuel pipe wound spirally.

Furthermore, in the fuel reforming device according to the present invention, the winding directions of the forward travel fuel pipe and the backward travel fuel pipe are different from each other. Especially, it is preferred that the forward travel fuel pipe is wound spirally in a clockwise direction toward the first direction, and the backward travel fuel pipe is wound spirally in a counterclockwise direction toward the second direction.

It is preferred that the ratio of the winding times of the forward travel fuel pipe to the winding times of the backward travel fuel pipe is any of 8±0.5:5±0.5, 13±0.5:6±0.5 and 27±0.5:9±0.5. In these ratios, a precise ratio of 8:5, 13:6 or 27:9 is more preferable.

Since the forward travel fuel pipe is wound toward the first direction with a spiral diameter gradually decreasing and the backward travel fuel pipe is wound toward the second direction with a spiral diameter gradually increasing, the respective pipes are wound so as to be formed as a schematic cone as a whole. In this cone-type winding, it is preferred that each of the pipes is wound so that the position of a vertex of the cone is eccentric relative to the position of the center of the base of the cone. Especially, the vertical sectional shape of the above-described cone is preferred to be formed as a shape along a right-angled triangle, and among such formations, it is preferred that the right-angled triangle has a dimensional ratio of $2:\sqrt{3}:1$.

Although it is possible that the above-described flow direction reversing pipe is constructed by a simple pipe for reversing direction, it is preferred that a part of the flow path of the flow direction reversing pipe is formed by a crystal. To form the flow path made from a crystal makes it possible to further increase the fuel reforming effect by a contact reaction of a fuel and the crystal until the fuel reaches the backward travel fuel pipe from the forward travel fuel pipe.

It is preferred that a series of fuel pipes are contained in a tubular body, and the filler is filled in the tubular body. A shape of the tubular body is not particularly limited, but preferably the tubular body has a cross section of a polygon, for example, a hexagon.

Such a fuel reforming device is used particularly for reforming fuel for internal combustion engines. The kinds of internal combustion engines are not particularly restricted, and the device can be applied to both of a gasoline engine and a diesel engine. As for the engines, the device can be applied to an internal combustion engine not only for motorcars but also for ships and others. Further, the fuel reforming device according to the present invention can be applied for reforming fuel for not only internal combustion engines that use gasoline, kerosene, light oil and heavy oil and the like but also external combustion engines such as burners for boilers and the like.

In the fuel reforming device according to the present invention as described above, by disposing the fuel reforming device between a fuel tank and a combustion engine and merely passing fuel from a fuel tank through the fuel reforming device, the fuel can be reformed to reduce the exhaust volume of the exhaust smoke, nitrogen oxides and carbon dioxide, and to improve the fuel consumption rate. Especially, as shown in Examples described later, with respect to exhaust smoke and nitrogen oxides which have been considered to be in a trade-off relationship with each other, surprisingly, the volume of the exhaust smoke can be reduced down to substantially zero, while the exhaust volume of nitrogen oxides can be greatly reduced.

THE BEST MODE FOR CARRYING OUT THE INVENTION

Hereinafter, desirable embodiments of the present invention will be explained referring to Figures.

Figure 1:
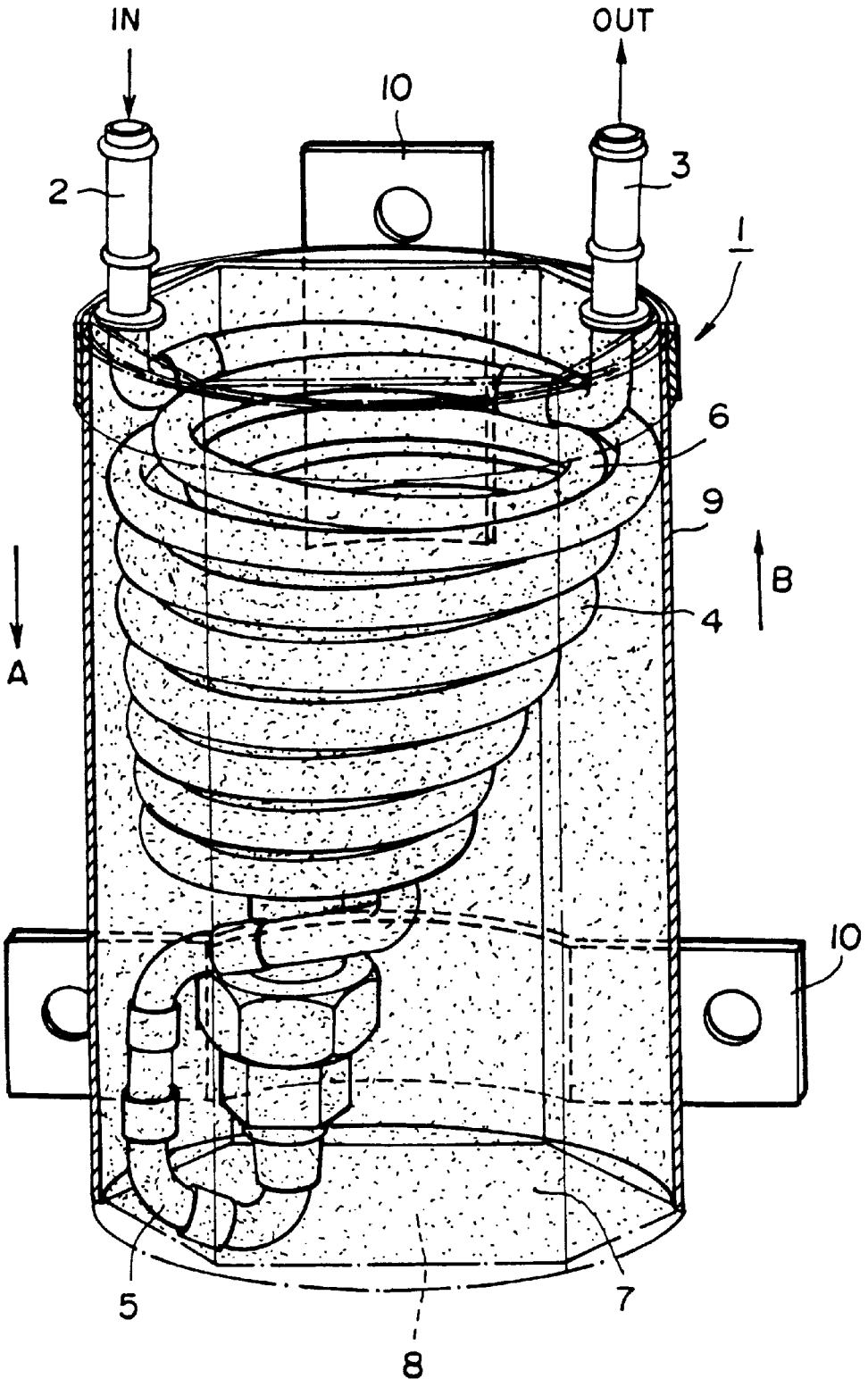
FIG. 1 is a perspective view of a fuel reforming device according to a first embodiment of the present invention.
Figure 2:
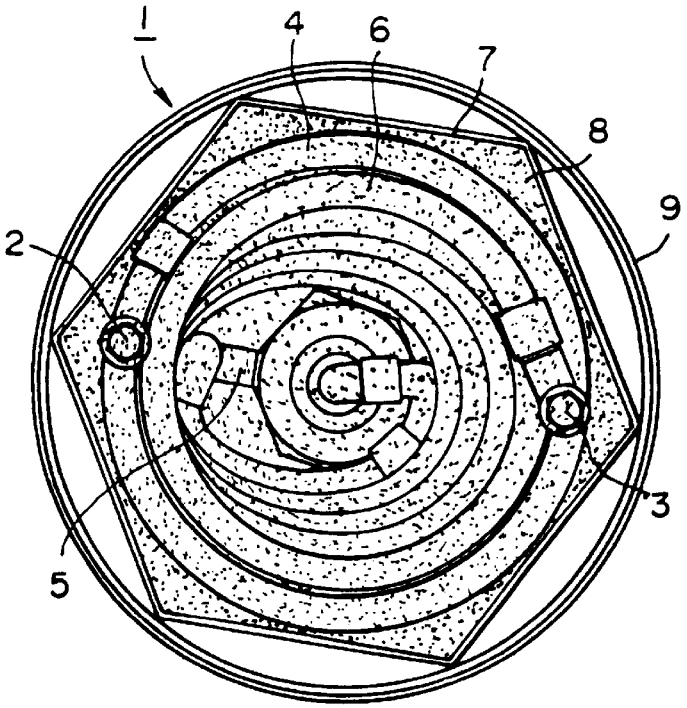
FIG. 2 is a plan view of the device shown in FIG. 1.

FIGS. 1 to 5 show a fuel reforming device according to a first embodiment of the present invention. In FIGS. 1 and 2, numeral 1 indicates the whole of a fuel reforming device. The fuel reforming device 1 has a fuel lead-in pipe 2 through which fuel is introduced, a fuel lead-out pipe 3 which discharges the fuel reformed by the fuel reforming device 1. A forward travel fuel pipe 4 is connected to and communicated with the fuel lead-in pipe 2. The forward travel fuel pipe 4 is wound spirally toward a first direction A with a spiral diameter gradually decreasing.

A flow direction reversing pipe 5 is connected to and communicated with an end portion of the forward travel fuel pipe 4 at the side opposite to the fuel lead-in pipe 2. The flow direction reversing pipe 5 reverses the flow direction of the fuel which has been sent through the forward travel fuel pipe 4 from the first direction A to a second direction B opposite to the first direction A.

A backward travel fuel pipe 6 is connected to and communicated with an end portion of the flow direction reversing pipe 5 at the side opposite to the forward travel fuel pipe 4. The backward travel fuel pipe 6 is wound spirally toward the second direction B in a winding direction opposite to that of the forward travel fuel pipe 4 with a spiral diameter gradually increasing. In this embodiment, the backward travel fuel pipe 6 is disposed substantially at the same position as that of the forward travel fuel pipe 4 wound spirally, and is wound spirally inside the forward travel fuel pipe 4. The fuel lead-out pipe 3 is connected to and communicated with an end portion of the backward travel fuel pipe 6 at the side opposite to the flow direction reversing pipe 5.

Figure 3:
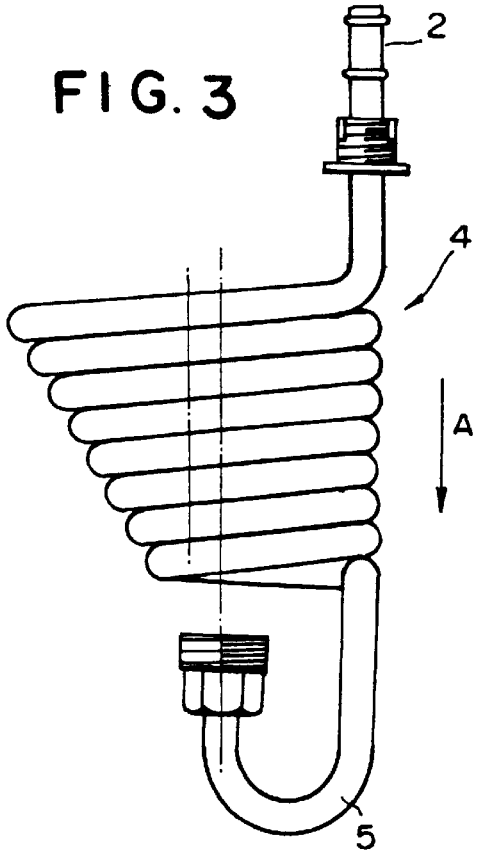
FIG. 3 is a side view of the forward travel fuel pipe and the vicinity of the device shown in FIG. 1.
Figure 4:
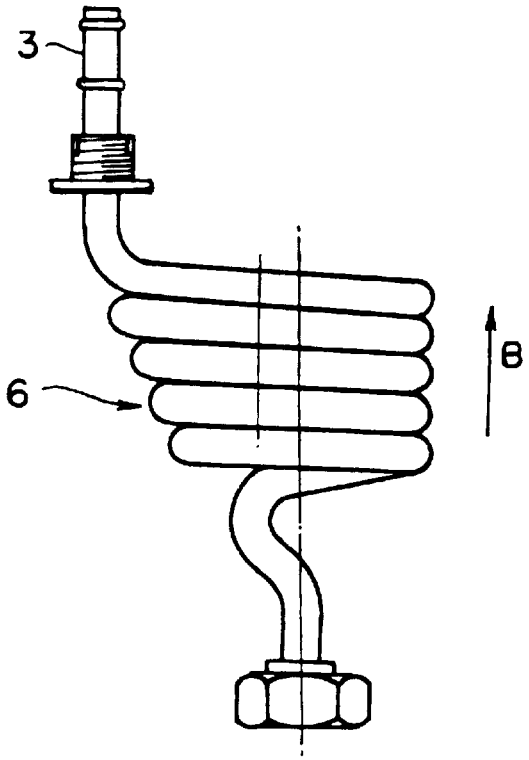
FIG. 4 is a side view of the backward travel fuel pipe and the vicinity of the device shown in FIG. 1.

Each of the forward travel fuel pipe 4 and the backward travel fuel pipe 6 is wound spirally so as to be formed as a schematic cone as a whole, as shown in FIGS. 3 and 4. And, the winding is carried out so that the position of a vertex of each cone is eccentric relative to the position of a center of a base of the cone.

Figure 5:
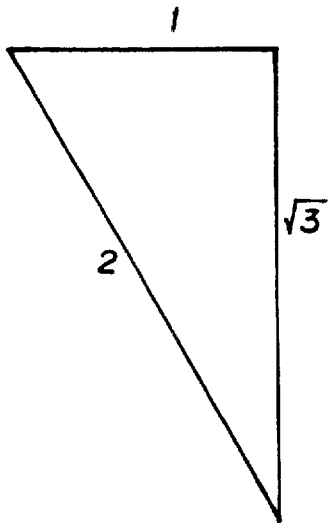
FIG. 5 is a triangle representing an example of an approximate cone shape of the whole of a spiral fuel pipe.

The spiral winding into this form of an eccentric cone shape can be achieved, for example, by winding each fuel pipe along a tool preformed in a predetermined shape. In this embodiment, as shown in FIG. 5, the spiral winding into the eccentric cone shape is carried out along a right-angled triangle, especially, along a right-angled triangle with a dimensional ratio of 2: $\sqrt{3}$:1.

Further, in this embodiment, the forward travel fuel pipe 4 is wound spirally in a clockwise direction toward the first direction A. On the other hand, the backward travel fuel pipe 6 is wound spirally in a counterclockwise direction toward the second direction B.

Furthermore, in this embodiment, the number of winding times of the forward travel fuel pipe 4 is set at 8, and the number of winding times of the backward travel fuel pipe 6 is set at 5. With respect to the number of winding times, as a result of various examinations, the ratio of 8:5 was decided because the most effective result was obtained when the ratio of the number of winding times of the forward travel fuel pipe to that of the backward travel fuel pipe was at the ratio of 8:5. Therefore, from the result of this examination, it is considered that the ratio of the number of winding times of the forward travel fuel pipe to that of the backward travel fuel pipe is preferably within the range of about 8±0.5:5±0.5. Further, from the results of other similar examinations, it was found to be preferred that the ratio of the number of winding times of the forward travel fuel pipe to that of the backward travel fuel pipe was within the range of 13±0.5:6±0.5 or 27±0.5:9±0.5.

When a material of a pipe for forming the above-described fuel flow path, especially a material of at least the forward travel fuel pipe 4 and the backward travel fuel pipe 5, is copper or a copper-system material, a good result effective to reform a fuel was obtained from the examination results. In the examinations, a copper pipe was mainly used. The reason why an excellent effect could be obtained by using the copper pipe is not precisely investigated, but, at least from the point of view that use of an iron-system material for the pipe could not achieve the same level in effect as that obtained by use of a copper pipe, it is considered to be preferred that copper or copper-system material (for example, brass) is used.

The main body of the fuel reforming device 1 thus constructed is contained in a tubular body 7 as shown in FIGS. 1 and 2. Then, filler 8 containing a silicate compound is charged, and the filler 8 is placed at least around the forward travel fuel pipe 4, the flow direction reversing pipe 5 and the backward travel fuel pipe 6.

In this embodiment, the tubular body 7 is formed in a polygon, especially, a hexagon in its cross section. Further, a cylindrical housing 9 is provided outside this hexagonal tubular body 7, and a double-tube structure is constituted as a whole. By forming such a double-tube structure, the inside tubular body 7 is protected, as well as the strength thereof is maintained. Further, by forming the cross section of the tubular body 7 constituting an inner tube as a hexagon, the respective fuel pipes 4 and 6 disposed inside it can be made stable in figure.

In this embodiment, the filler 8 is prepared at a formation of powder and is charged into the tubular body 7. This filler 8 may be made from a silicate compound as a whole, and may be made from a mixture of the silicate compound and other substances. The filler 8 comprises, for example, a powder of silicate dioxide, ceramic powder and the like.

Where, numeral 10 in FIG. 1 indicates a stay for fixing the housing 9, and the fuel reforming device 1 is attached to an appropriate external fastening portion via the stay 10.

Figure 6:
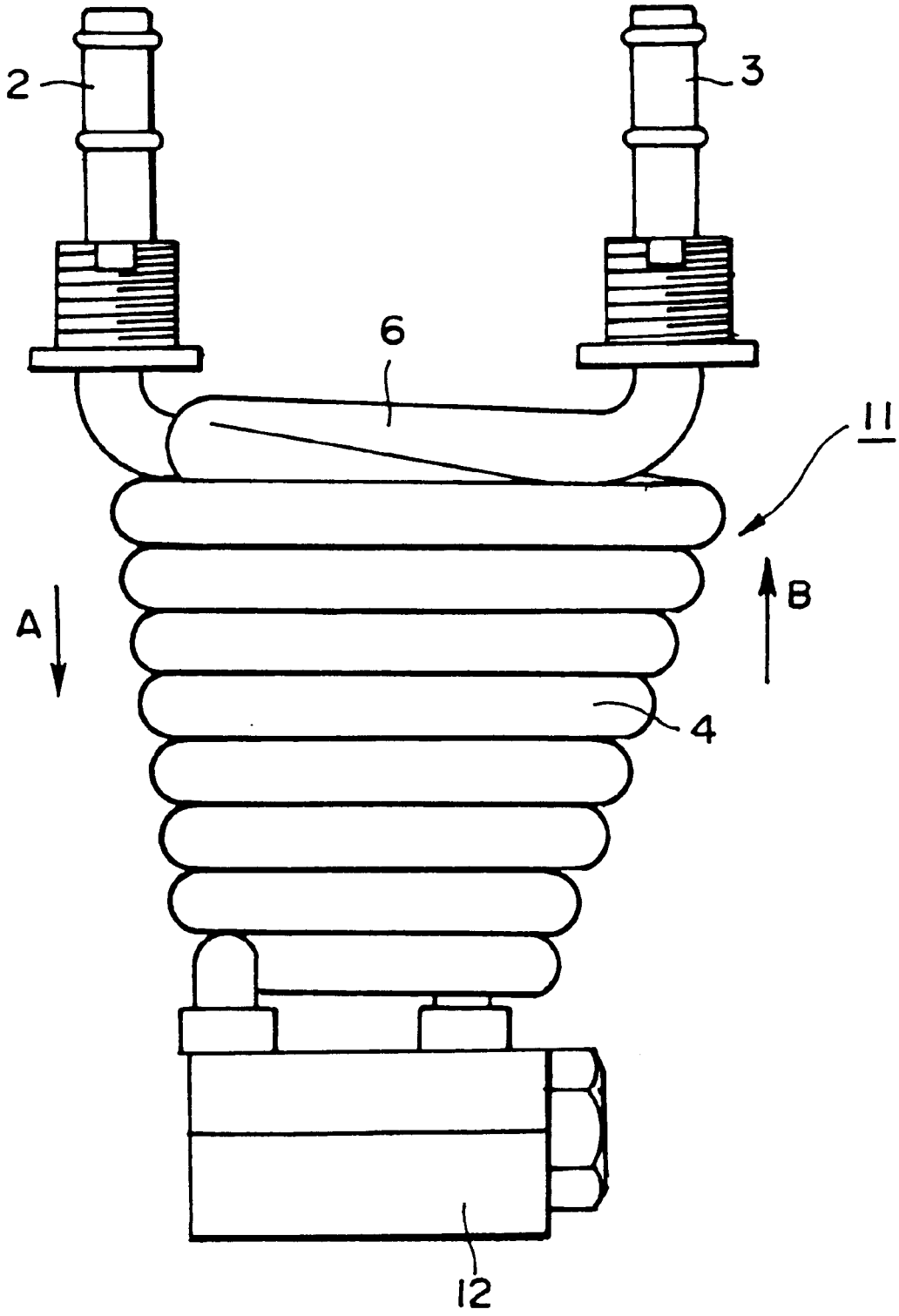
FIG. 6 is a side view of a main portion of a fuel reforming device according to a second embodiment of the present invention.
Figure 7:
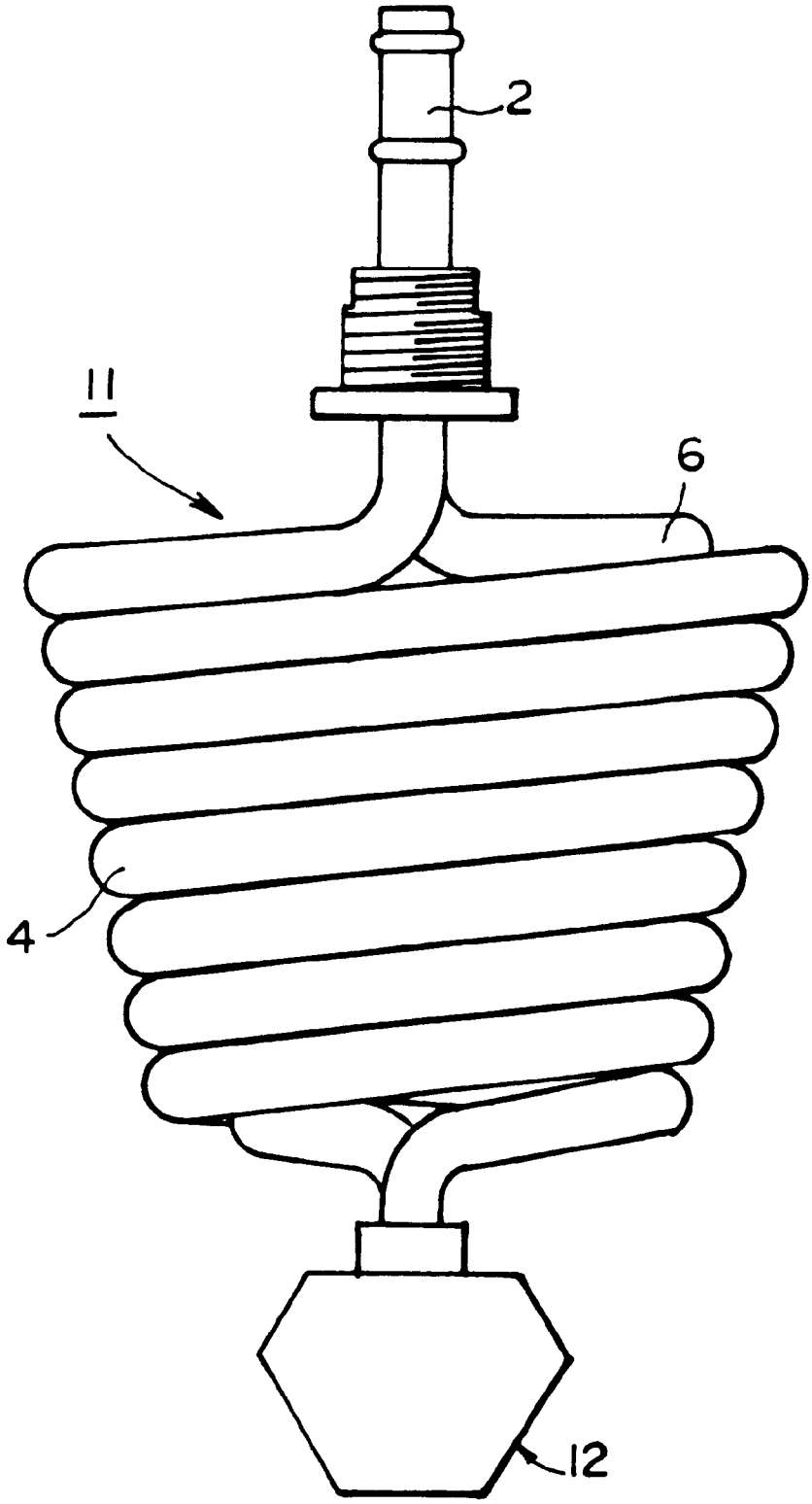
FIG. 7 is a side view of the device shown in FIG. 6, as viewed from a 90° different direction.
Figure 8:
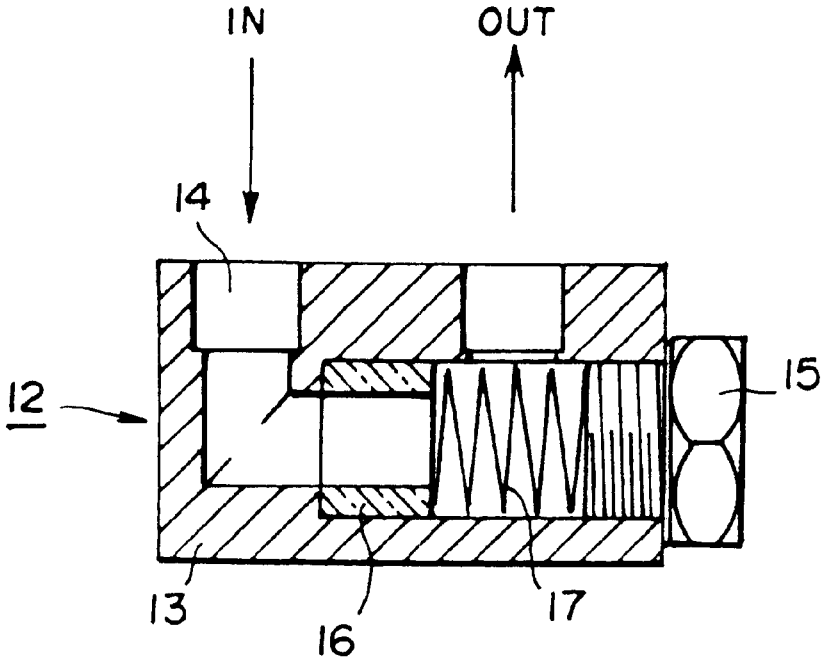
FIG. 8 is an enlarged sectional view of a portion installed with a crystal in the device shown in FIG. 6.

FIGS. 6 to 8 show a main portion of a fuel reforming device 11 according to a second embodiment of the present invention. The tubular body 7, the filler 8, the housing 9, the stay 10 and the like are omitted from the Figures because their structures are designed substantially along those in the above-described first embodiment.

In the fuel reforming device 11 according to this second embodiment, a part of a flow path of a flow direction reversing pipe 12 is formed by a crystal. The flow direction reversing pipe 12 is formed by adding a reversing flow path 14 in a column-like body 13 made from a brass having a cross section of a hexagon, and a hole portion for processing is closed by a plug 15. In this embodiment, a tubular crystal body 16 is inserted into and fixed to a U-shaped base of the reversing flow path 14 formed as a U-shape, at a condition urged by a spring 17.

In such a fuel reforming device 11 wherein a part of the flow path of the flow direction reversing pipe 12 is formed by a crystal, a contact reaction of the crystal and fuel is caused at the portion formed by the crystal, thereby further reforming the fuel. Especially, as shown in the result of the examination described later, the output horsepower of an internal combustion engine could be increased by providing the crystal body 16 as compared with the case of no crystal body.

Figure 9:
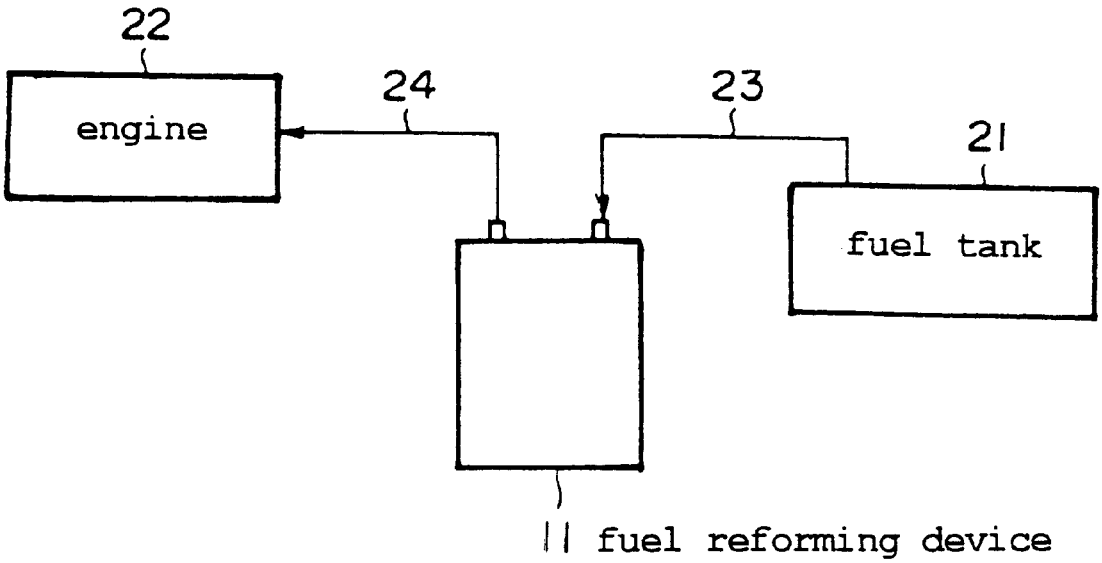
FIG. 9 is a schematic block diagram showing a method of examination.

In order to investigate the performance of the fuel reforming device according to the present invention constructed as described above, the following examination was carried out. As shown in FIG. 9, the examination was carried out at a condition where the fuel reforming device 11 with the crystal among the aforementioned fuel reforming devices was provided between a fuel tank 21 and an engine 22 for a motorcar, and the portions therebetween were connected by pipes 23 and 24, respectively.

Examination 1

Especially the concentration of the exhaust smoke, the exhaust volume of carbon dioxide, the exhaust volume of nitrogen oxides, the fuel consumption rate and the like were measured in the examination using an actual motorcar and an engine mounted in the motorcar. Measuring apparatuses used in the Examination are as follows.

chassis dynamnmeter:CHDY-9052 produced by MEIDENSHA Corporation exhaust gas analyzer:ALK-5200GD produced by KOYO SEIKO Corporation exhaust gas constant volume sampling apparatus:CVS-9300 produced by HORIB SEISAKUSHO Corporation fuel flow rate detector:FP-2240H produced by ONO SOKKI Corporation fuel flow rate integrator:DF-2420 produced by CNO SOKKI Corporation The examination was carried out as for"AVENIR" which was a motorcar produced by NISSAN MOTORCAR Corporation and whose type was KH-SW11, mounted with an engine of CD20 (a diesel turbo engine) 4AT having a total displacement of 1973 cc at a condition of a total mileage of 34,000 km. Light oil was used as the fuel. Table 1 shows the result. Comparative Example 1 shows the result in the case where the fuel reforming device 11 was not mounted, and Example 1 shows the result in the case where the fuel reforming device 11 was mounted.

Where, the concentration of the exhaust smoke was measured using an exhaust gas concentration measuring apparatus (type: GSM-2, produced by TSUKS SOKIEN Corporation), and the average pollution level of three-time measurements at engine rotational speeds of 5100 rpm, 5096 rpm and 5098 rpm was measured. Further, the fuel consumption rate was determined at diesel 10–15 mode.

TABLE 1

| | Measuring items | | | | | |
|---|---|---|---|---|---|---|
| | CO (Carbon Oxide) [g/km] (degree of improvement) | HC Hydro Carbon [g/km] (degree of improvement) | NOx Nitrogen oxides [g/km] (degree of improvement) | $CO_2$ (Carbon Dioxide) [g/km] (degree of improvement) | Fuel consumption rate [km/L] (degree of improvement) | Concentration of black smoke [%] (degree of improvement) |
| Comparative Example 1 | 0.51 | 0.05 | 0.63 | 267.00 | 10.24 | 25.00 |
| Example 1 | 0.456 (−10.60%) | 0.05 (±0%) | 0.42 (−33.30%) | 223.30 (−16.40%) | 10.60 (3.50%) | 0.00 (−100.00%) |

As shown in Table 1, when the fuel reforming device according to the present invention was mounted (Example 1), as compared with the case where the device was not mounted (Comparative example 1), the exhaust volume of nitrogen oxides could be greatly reduced (−33.30%) while the concentration of the exhaust smoke (the concentration of black smoke) could be surprisingly reduced to 0% (−100% at the degree of improvement), which had been considered to be in a trade-off relationship with each other. Further, at the same time, although the exhaust volume of HC was not improved so much, the exhaust volume of CO could be greatly reduced by a percentage of −10.60% and the exhaust volume of $CO_2$ could be greatly reduced by a percentage of −16.40%. Moreover, the fuel consumption rate could be improved by a percentage of 3.50%.

Examinations 2–4

As to the following kinds of cars, especially the effects in improvement of fuel consumption rates were investigated at a standard road running condition at 60 km/hr, in a manner similar to that of Examination 1.

Examination 2

Kind of car:"VANETTE" produced by NISSAN MOTORCAR Corporation

Engine: R2 (diesel engine)

Total displacement: 2200 cc

Total mileage: 53,800 km

Examination 3

Kind of car: "HOMY" produced by NISSAN MOTORCAR Corporation

Engine: TD27 (diesel engine)

Total displacement: 2700 cc

Total mileage: 86,000 km

Examination 4

Kind of car: "CARAVAN" produced by NISSAN MOTORCAR Corporation

Engine: TD27 (diesel engine)

Total displacement: 2700 cc

Total mileage: 67,400 km

As the result, the fuel consumption rate could be improved by 2.70% in Examination 2, by 4.20% in Examination 3, and by 5.30% in Examination 4, respectively.

Examination 5

Although the above-described respective examinations were carried out as to diesel engines, in Examination 5 it is confirmed that an effect was obtained also for a gasoline engine. The Examination was carried out using"WINGROAD" produced by NISSAN MOTORCAR Corporation as a kind of motorcar, at conditions of an engine: GA15DE (gasoline engine), a displacement: 1500 cc, a total mileage: 59,625 km and used fuel: normal gasoline. As the result, by mounting the fuel reforming device according to the present invention, the fuel consumption rate of standard road running at 60 km/hr could be improved by 1.64% at a load condition of 6.4 PS, and the fuel consumption rate of standard road running at 80 km/hr could be improved by 5.9% at a load condition of 17.2 PS.

Examination 6

With respect to the aforementioned fuel reforming device 11 having a crystal, an effect obtained by using the crystal was confirmed by comparing the case using the crystal with the case with no crystal. The kind of motorcar for the examination was "AD VAN" produced by NISSAN MOTORCAR Corporation, wherein the engine was CD17 (diesel engine), the displacement was 1700 cc and the total mileage was 150,000 km, and the effect was evaluated with its output horse power.

First, when the examination was carried out by mounting the fuel reforming device according to the present invention without using the crystal, the output greatly increased from 40 PS to 52 PS. Then, when the fuel reforming device with the crystal was mounted, the output further increased up to 54 PS. Therefore, it is understood that the fuel was further reformed by the contact reaction with the crystal.

Further, to investigate the performance of the fuel reforming device according to the present invention, the fuel reforming device 11 according to the second embodiment of the present invention as shown in FIG. 6 was mounted in an actual motorcar, and the variation with time in the fuel reforming effect was determined.

Examination 7

The Examination was carried out using"SERENA" produced by NISSAN MOTOR CAR Corporation as a kind of motorcar, at conditions of an engine: CD20 (diesel turbo engine), a displacement: 2000 cc and a total mileage: 210,000 km, and the effect was evaluated with its concentration of black smoke (concentration of exhaust smoke). The concentration of the exhaust smoke was measured by using an exhaust smoke concentration measuring apparatus (type: GSM-2, produced by TSUKASA SOKKEN Corporation), and an average pollution level of three time measurements at engine rotational speeds of 5100 rpm, 5096 rpm and 5098 rpm was measured similarly in Examination 1. The examination was carried out from Oct. 13th 1999 to Oct. 30th 2000, the above-described fuel reforming device according to the present invention was mounted on Nov. 6th 1999, and at that condition, the variation of the concentration of black smoke was measured for about 1 year until Oct. 30th 2000.

Figure 10:
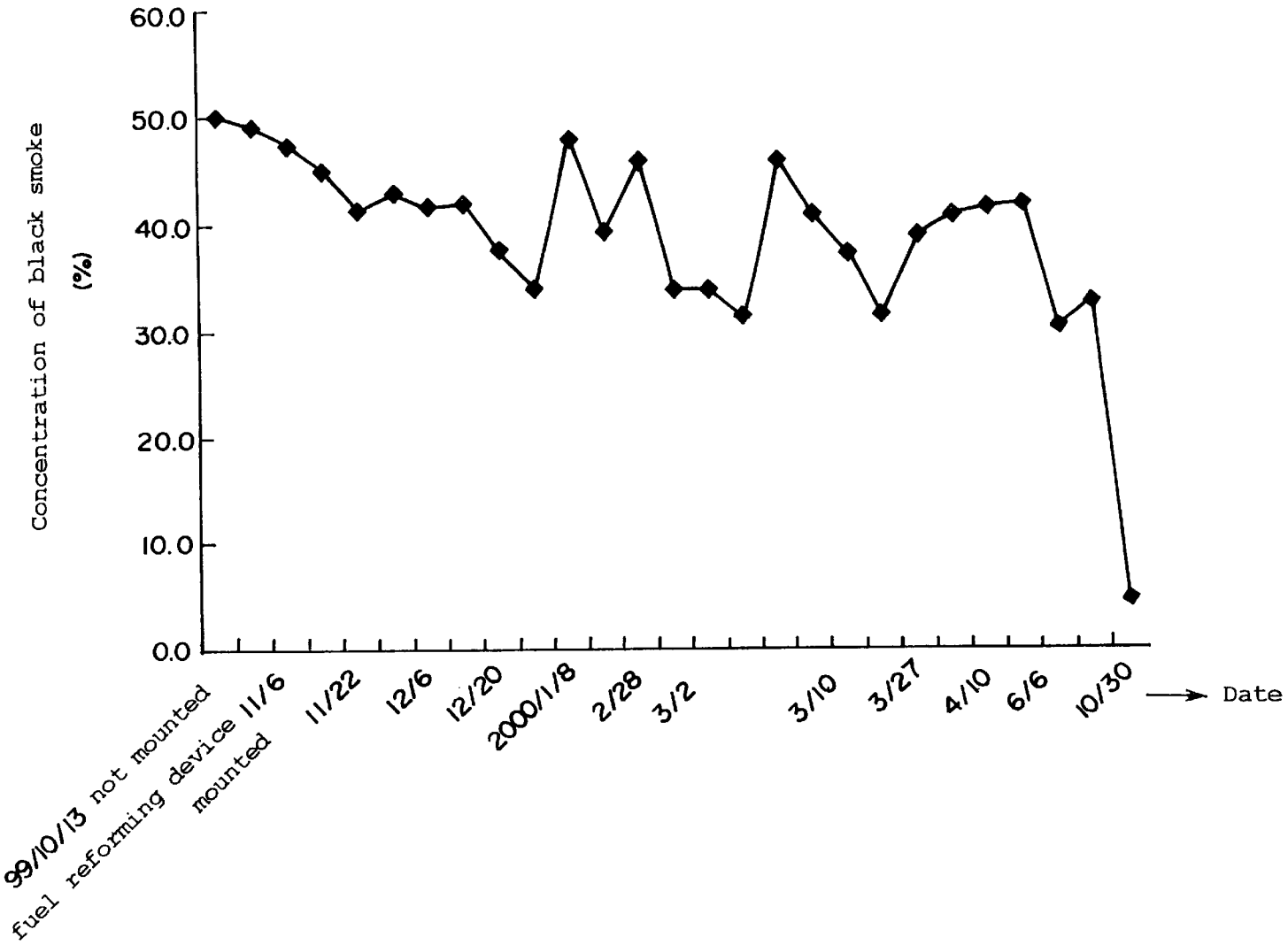
FIG. 10 is a graph showing a characteristic in variation with time of black smoke at the time of an examination in that the fuel reforming device according to the second embodiment of the present invention was mounted in an actual motorcar.

FIG. 10 shows the result of the Examination. As shown in FIG. 10, after the fuel reforming device according to the present invention was mounted, the concentration of black smoke was gradually reduced as a whole, and therefore, a clear fuel reforming effect could be confirmed. Where, the reason why the concentration of black smoke increased temporarily on the way of the examination is considered that the total mileage of the motorcar used for the examination was large to make the inside of the engine significantly dirty, the deteriorated substances having adhered to the inside of the engine were exhausted by cleaning due to the fuel reforming effect, and as a result, the concentration of black smoke increased. However, when the variation during about 1 year measurement is observed as a whole, because the concentration of black smoke was obviously reduced, an apparent effect could be confirmed by the fuel reforming.

Next, how the fuel was reformed by the fuel reforming device according to the present invention was investigated.

Examination 8

Figure 11A:
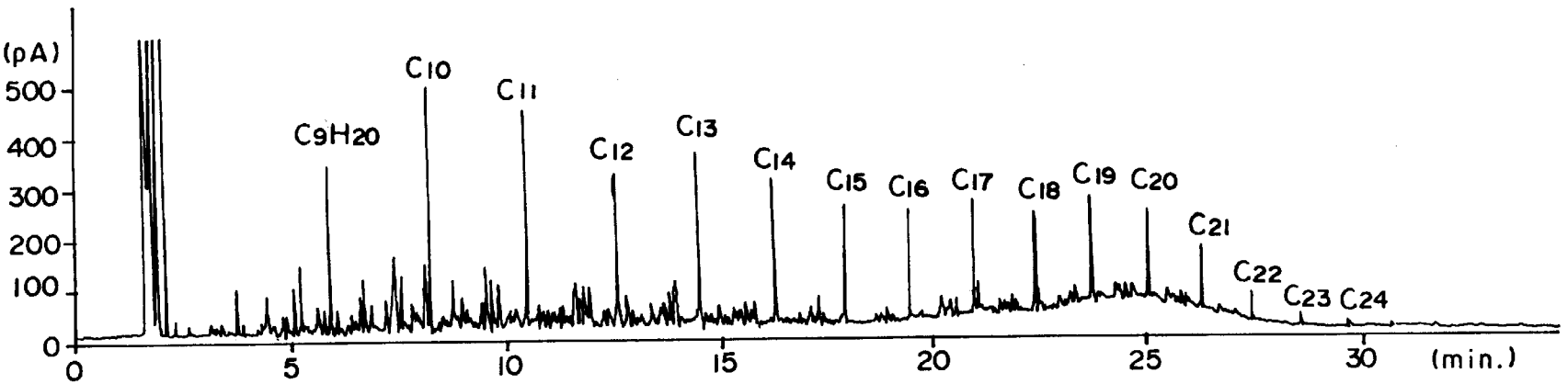
FIGS. 11A and 11B are chromatograms concerning aliphatic saturated hydrocarbons of a fuel after and before reforming the fuel using the fuel reforming device according to the second embodiment of the present invention.
Figure 11B:
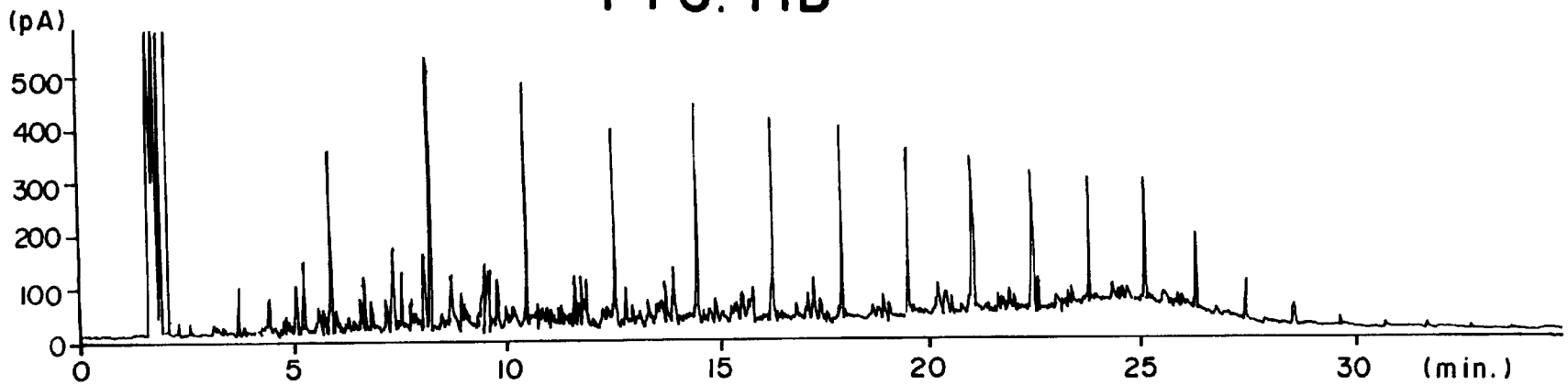

Light oil (produced by NISSEKI MITSUBISHI Corporation) for diesel engines was prepared as a fuel used for the examination, and a distribution of aliphatic saturated hydrocarbons of the fuel before and after reforming by using the fuel reforming device according to the above-described second embodiment of the present invention was determined by chromatography. Namely, the measurement for investigating a difference between the amounts of the aliphatic saturated hydrocarbons was carried out, and the states before and after the fuel reforming were compared using a peak area value (PA). In the measurement, the pA of $C_9H_{20}$ was referred to as a value of 1, and the rates relative to the value of $C_9H_{20}$ of the respective hydrocarbons different in number of carbon were determined. Table 2 and FIG. 11 show the result. FIG. 11A shows the rate before reforming, and FIG. 11B shows the rate after reforming.

TABLE 2

| Carbon number | $C_9$ | $C_{10}$ | $C_{11}$ | $C_{12}$ | $C_{13}$ | $C_{14}$ |
|---|---|---|---|---|---|---|
| Before reforming | 1.00 | 1.70 | 1.38 | 0.92 | 1.16 | 0.96 |
| After reforming | 1.00 | 1.76 | 1.49 | 1.10 | 1.44 | 1.36 |
| Carbon number | $C_{15}$ | $C_{16}$ | $C_{17}$ | $C_{18}$ | $C_{19}$ | $C_{20}$ |
| Before reforming | 0.84 | 0.68 | 0.68 | 0.61 | 0.75 | 0.71 |
| After reforming | 1.32 | 1.08 | 0.98 | 0.85 | 0.86 | 0.76 |
| Carbon number | $C_{21}$ | $C_{22}$ | $C_{23}$ | $C_{24}$ | | |
| Before reforming | 0.46 | 0.18 | 0.08 | 0.04 | | |
| After reforming | 0.51 | 0.25 | 0.13 | 0.07 | | |

Among the above-described hydrocarbons different in number of carbon, hydrocarbons having a number of carbon in the range of about 13 to 18 are generally considered to be suitable for diesel engines and to be well burned. As is evident from Table 2 and FIG. 11, the amounts of hydrocarbons having a number of carbon in the range of 13 to 18 are all increased, and it is understood that the fuel is reformed effectively.

Examination 9

Figure 12:
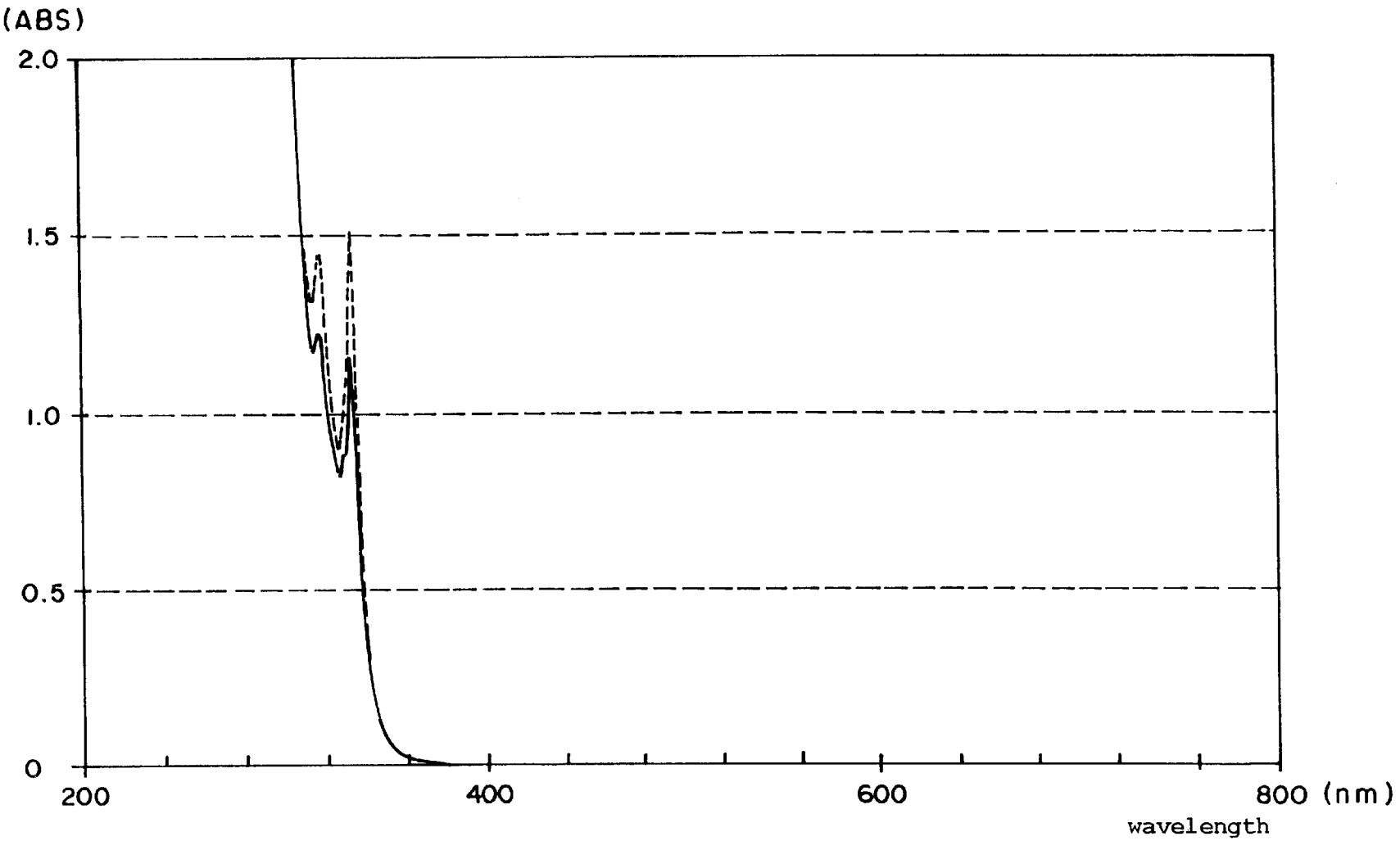
FIG. 12 shows photoabsorption spectra when measuring compounds having double bond in a solution diluted by 100 times by fuel octane after and before reforming a fuel using the fuel reforming device according to the second embodiment of the present invention.
Figure 13:
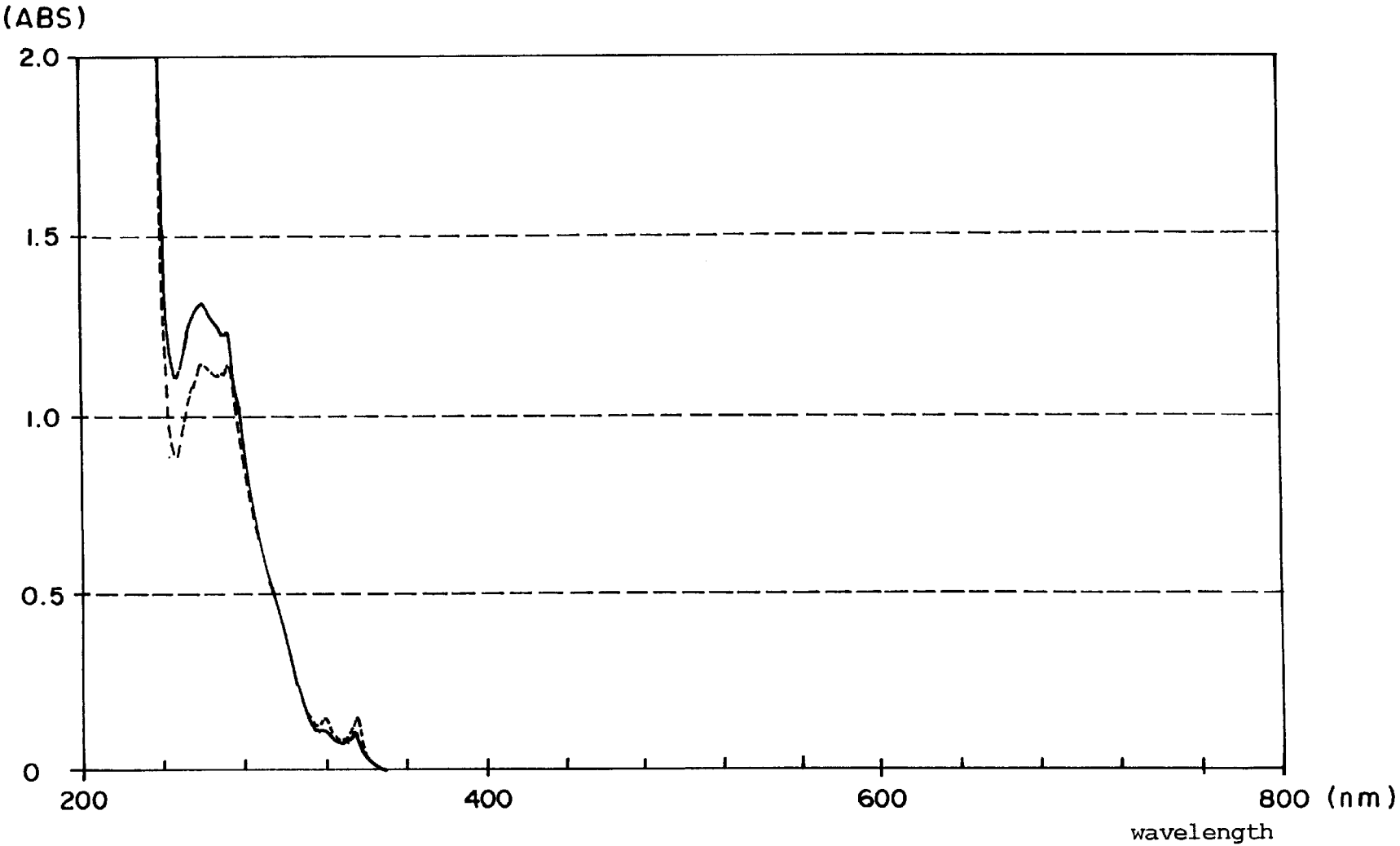
FIG. 13 shows photoabsorption spectra when measuring aromatic compounds in a solution diluted by 1000 times by fuel octane after and before reforming a fuel using the fuel reforming device according to the second embodiment of the present invention.

Further, using the same fuel as that in Examination 8, it was investigated that the fuel was reformed, by measuring photoabsorption spectra before and after reforming. FIGS. 12 and 13 show the result of the measurement. FIG. 12 shows the photoabsorption spectra of the fuel before and after reforming when reforming the above-described fuel using the fuel reforming device according to the second embodiment of the present invention, and shows the absorption spectra of, especially, the compounds with double bond in a dilute solution, prepared by diluting the fuel with octane by 100 times. The solid line indicates the property after reforming, and the dotted line indicates the property before reforming, respectively. Further, FIG. 13 shows the photoabsorption spectra of the fuel before and after reforming when reforming the fuel using the fuel reforming device according to the second embodiment of the present invention, and shows the absorption spectra of, especially, the aromatic compounds in a dilute solution, prepared by diluting the fuel with octane by 1000 times. The solid line indicates the property after reforming, and the dotted line indicates the property before reforming, respectively. As is evident from FIGS. 12 and 13, it is understood that the conditions of the contained compounds with double bond and aromatic compounds were changed between before and after reforming. The changes of these properties are considered to show the fuel reforming effect obtained by the device according to the present invention.

Although the above-described respective examinations were carried out as to engines for motorcars and the fuel therefor, since a basic structure of an engine is the same as that for other applications, for example, for ships, it is obvious that the same effect can be obtained for engines for such other applications and the fuel therefor.

Thus, in the fuel reforming device according to the present invention, it becomes possible to greatly reduce both of exhaust smoke and nitrogen oxides, also to reduce other compounds such as carbon dioxide and the like, and besides to improve the fuel consumption rate and the output of engines using the reformed fuel.

Industrial Application of the Invention

The fuel reforming device according to the present invention is effective for reforming fuel for various kinds of internal combustion engines and external combustion engines. Since the fuel reforming makes it possible to greatly reduce both of exhaust smoke and nitrogen oxides and reduce other compounds such as carbon dioxide and the like, it is useful to improve atmosphere environment. Further, use of reformed fuel enables to improve the fuel consumption rate and output of an engine.

What is claimed is:

1. A fuel reforming device comprising a fuel lead-in pipe, a forward travel fuel pipe communicated with said fuel lead-in pipe and wound spirally toward a first direction with a spiral diameter gradually decreasing, a flow direction reversing pipe for reversing the direction of fuel flow from said forward travel fuel pipe in a second direction opposite to the first direction, a backward travel fuel pipe communicated with said flow direction reversing pipe and wound spirally toward the second direction with a spiral diameter gradually increasing in a winding direction opposite to that of said forward travel fuel pipe, and a fuel lead-out pipe communicated with said backward travel fuel pipe, wherein a filler containing a silicon compound is placed around said forward travel fuel pipe, said flow direction reversing pipe and said backward travel fuel pipe.

2. The fuel reforming device according to claim 1, wherein said filler is formed as powder.

3. The fuel reforming device according to claim 1, wherein at least said forward travel fuel pipe and said backward travel fuel pipe are made from copper or a copper-system material.

4. The fuel reforming device according to claim 1, wherein said backward travel fuel pipe is wound spirally inside said forward travel fuel pipe wound spirally.

5. The fuel reforming device according to claim 1, wherein said forward travel fuel pipe is wound spirally in a clockwise direction toward said first direction, and said backward travel fuel pipe is wound spirally in a counterclockwise direction toward said second direction.

6. The fuel reforming device according to claim 1, wherein a ratio of the number of winding times of said forward travel fuel pipe to that of said backward travel fuel pipe is any of 8±0.5:5±0.5, 13±0.5:6±0.5 and 27±0.5:9±0.5.

7. The fuel reforming device according to claim 1, wherein each of said forward travel fuel pipe and said backward travel fuel pipe is wound so as to be formed as a schematic cone as a whole, and so that the position of a vertex of said cone is eccentric relative to the position of a center of a base of said cone.

8. The fuel reforming device according to claim 7, wherein a vertical sectional shape of said cone is formed as a shape along a right-angled triangle.

9. The fuel reforming device according to claim 8, wherein said right-angled triangle has a dimensional ratio of $2:\sqrt{3}:1$.

10. The fuel reforming device according to claim 1, wherein a part of the flow path of said flow direction reversing pipe is formed by a crystal.

11. The fuel reforming device according to claim 1, wherein its cross section is contained in a polygonal tubular body.

12. The fuel reforming device according to claim 1, wherein said device is used for reforming fuel for internal combustion engines or for external combustion engines.

* * * * *

UNITED STATES PATENT AND TRADEMARK OFFICE

CERTIFICATE OF CORRECTION

PATENT NO. : 6,474,316 B1
DATED : November 5, 2002
INVENTOR(S) : Yamaguchi et al.

It is certified that error appears in the above-identified patent and that said Letters Patent is hereby corrected as shown below:

Title page,
Item [22], please change "May 30, 2001" to -- March 30, 2001 --; and please insert -- [30] Foreign Application Priority Data, Apr. 3, 2000 (JP) Japan…… 2000-100391 --

Signed and Sealed this

Twenty-ninth Day of July, 2003

JAMES E. ROGAN
*Director of the United States Patent and Trademark Office*